US010857662B2

(12) United States Patent
Rohlfs

(10) Patent No.: US 10,857,662 B2
(45) Date of Patent: Dec. 8, 2020

(54) HAND-HELD TOOL AND METHOD FOR PRODUCING SUCH A HAND-HELD TOOL

(71) Applicant: Kirchhoff Witte GmbH, Iserlohn (DE)

(72) Inventor: Frank Rohlfs, Hagen (DE)

(73) Assignee: KIRCHHOFF WITTE GMBH, Iserlohn (DE)

( * ) Notice: Subject to any disclaimer, the term of this patent is extended or adjusted under 35 U.S.C. 154(b) by 132 days.

(21) Appl. No.: 15/578,026

(22) PCT Filed: May 31, 2016

(86) PCT No.: PCT/EP2016/062280

§ 371 (c)(1),
(2) Date: Dec. 8, 2017

(87) PCT Pub. No.: WO2016/193266

PCT Pub. Date: Dec. 8, 2016

(65) Prior Publication Data

US 2018/0290287 A1 Oct. 11, 2018

(30) Foreign Application Priority Data

Jun. 1, 2015 (DE) ..... 20 2015 102 811 U

(51) Int. Cl.
*B25G 3/34* (2006.01)
*B25G 3/14* (2006.01)
*B25B 15/02* (2006.01)

(52) U.S. Cl.
CPC ..... *B25G 3/34* (2013.01); *B25B 15/02* (2013.01); *B25G 3/14* (2013.01)

(58) Field of Classification Search
CPC ..... B25G 3/34; B25G 3/14; B25B 15/02
(Continued)

(56) References Cited

U.S. PATENT DOCUMENTS 5,390,572 A 2/1995 Gakhar et al.
2005/0115023 A1* 6/2005 Lin ..... B25G 1/00 16/110.1

(Continued)

FOREIGN PATENT DOCUMENTS

DE 19606366 C1 7/1997
EP 1923194 A1 * 5/2008 ..... B25G 1/01

(Continued)

OTHER PUBLICATIONS

Translation of EP1923194, retrieved from Espacenet on May 30, 2019 (Year: 2013).*

(Continued)

*Primary Examiner* — David B. Thomas
*Assistant Examiner* — Thomas Raymond Rodgers
(74) *Attorney, Agent, or Firm* — Polson Intellectual Property Law, PC; Margaret Polson; Christopher Sylvain

(57) ABSTRACT

A hand-held tool comprises a tool part and a handle surrounding a section of the tool part and connected to same in a torque-transmitting manner. The tool part comprises a connection contour used to connect the handle in a torque-transmitting manner at least in some areas, in a section surrounded by the handle. The handle comprises an inner handle piece which can be connected to the connection contour and surrounds same in a torque-transmitting manner. With the inner handle piece slid onto the connection contour, one or more outwardly-open casting channels are provided between the two parts. The handle further comprises an outer handle piece made of plastic, which during the course of a plastic moulding process is moulded around the unit comprising the tool part which has an inner handle piece connected to the connection contour thereof, wherein the at least one casting channel is at least partially filled with the plastic material which forms the outer handle piece. A (Continued)

method is also described for producing such a hand-held tool.

15 Claims, 5 Drawing Sheets

(58) Field of Classification Search
USPC ..... 81/177, 436; 16/436; 264/279, 254
See application file for complete search history.

(56) References Cited

U.S. PATENT DOCUMENTS

| | | | | |
|---|---|---|---|---|
| 2007/0256276 | A1* | 11/2007 | Holland-Letz | B25G 1/01 16/111.1 |
| 2007/0290399 | A1 | 12/2007 | Easter et al. | |
| 2010/0107826 | A1* | 5/2010 | Gauthier | B25G 1/10 81/177.1 |

FOREIGN PATENT DOCUMENTS

| | | | |
|---|---|---|---|
| EP | 2407280 | A1 | 1/2012 |
| WO | 0114103 | A1 | 3/2001 |

OTHER PUBLICATIONS

Translation of EP1923194, Retrieved from Espacenet on Oct. 1, 2019 (Year: 2008).*
International Search Report dated Dec. 8, 2016 in parent international application PCT/EP2016/062280.
Written Opinion of the International Searching Authority dated Dec. 8, 2016 in parent international application PCT/EP2016/062280.
International Preliminary Report on Patentability, Ch. I, dated Dec. 5, 2017 in parent international application PCT/EP2016/062280.

* cited by examiner

HAND-HELD TOOL AND METHOD FOR PRODUCING SUCH A HAND-HELD TOOL

BACKGROUND

The present disclosure relates to a hand-held tool with a tool part and with a handle surrounding a section of the tool part and connected to the same in a torque-transmitting manner. Furthermore, the present disclosure relates to a method for producing such a hand-held tool.

Such hand-held tools include, for example, screwdrivers. In such a hand-held tool designed as a screwdriver, the tool part is the blade which comprises a torque-transmitting contour on its actuating end. The torque-transmitting contour can have different constructions, for example, such as a slot contour, a cross contour or almost any other contour which is suitable for transmitting a torque onto a screw comprising a corresponding counter contour. The end of the blade opposite the actuating end of with its torque-transmitting contour is generally flattened like a spatula. This flattened end serves for the torque-transmitting connection of a handle. Such a handle is typically a plastic part. This part is molded around the flattened end section of the blade in a plastic molding tool. It can be provided that the handle itself is produced from two different plastic components, wherein differences between the two plastic components can be conditioned by a different coloring and/or by a different hardness. Different colors are used in order to impart a certain design to the handle in its jacket surface. Different hardnesses are used in order to produce a certain haptic when grasping and using the handle. If different plastics are used for the construction of such a handle, wherein as a rule only two different plastics are used, this takes place by a so-called two-component injection-molding method. This means that in a first step for producing the handle, the geometry of the plastic molding tool is set for the geometry of the first plastic component. The tool geometry is subsequently changed so that the second plastic component can be molded in the same tool in a second step. Placing the semi-finished product of the screwdriver into another tool mold is also possible. The second plastic component fills the remaining hollow spaces in the tool cavity. When producing a hand-held handle with several plastic components, it is provided as a rule that the first plastic component lies free at least in areas. This component is typically a rather hard plastic whereas the second plastic component is a so-called soft component.

The production process for producing a hand-held tool with a handle consisting of two plastic components in such a manner is time-consuming due to the necessity of changing the tool from the geometry of the cavity for molding the first plastic component into the geometry of the cavity for molding the second plastic component. The cycle times in such an assistance module are correspondingly long. Further, if a change of shape or design regarding the handle is made, new tools must consequently be produced.

The foregoing examples of the related art and limitations therewith are intended to be illustrative and not exclusive. Other limitations of the related art will become apparent to those of skill in the art upon a reading of the specification and a study of the drawings.

SUMMARY

Proceeding from this background, the present disclosure sets forth a hand-held tool with a handle consisting of several components and a method for producing such a hand-held tool. According to the present disclosure, the handle-held tool can be produced with shorter cycle times and changes of shape and/or design in the construction of the handle can be carried out at a considerably reduced expense.

The following embodiments and aspects thereof are described and illustrated in conjunction with systems, tools and methods which are meant to be exemplary and illustrative, not limiting in scope. In various embodiments, one or more of the above described problems have been reduced or eliminated, while other embodiments may be directed to other improvements.

The problem related to these type of devices is solved according to the present disclosure by a hand-held tool comprising a tool part having a connection contour serving for the torque-transmitting connection of the handle at least in areas in a section of the tool part surrounded by the handle, and in which the handle has an inner handle piece which can be connected to the connection contour and surrounds the same in a torque-transferring manner. When the inner handle piece is slid onto the connection contour, one or more casting channels open to the outside are provided between the connection contour and the inner handle piece. The handle also comprises an outer handle piece made of plastic which is formed around the unit consisting of the tool part with an inner handle piece connected to its connection contour during a plastic molding process, and the at least one casting channel is filled at least partially with the plastic material forming the outer handle piece.

The problem related to the method is solved by a method according to the appended claims.

In the designing the handle of such a hand-held tool, the shaping of the construction of the inner handle piece is important. This is reflected in the appended claims. The inner handle piece forms the coupling piece between the hand-held portion of the tool part with its connection contour and the outer handle piece. This inner handle piece is typically in one piece, but, however, can also readily consist of several individual parts and can be connected to the connection part of the hand-held part. In one embodiment, the inner handle piece can be slid onto the connection contour in the longitudinal axial direction of the tool part. Likewise, embodiments are also possible in which the inner handle piece is composed of two shells in a multi-part construction that, when placed together, surround the connection contour of the tool part in a torque-transmitting manner. The ability to connect the inner handle piece to the connection contour of the tool part means that the inner handle piece is not necessarily injection-molded around the connection contour of the tool part but, rather, may be produced independently of the connection contour. The inner handle piece is preferably a plastic part. However, even inner handle pieces of other materials can be used in the same manner. Inner handle pieces made of plastic are generally preferred due to the economical production and the greater variability in the material used, especially also in the shaping of very different geometries.

The connection contour of the tool part is designed in such a manner that the inner handle piece can be attached to it in a torque-transmitting manner. The connection contour is preferably a plastic body sprayed around a section of the tool part—for example, the screwdriver blade—and is constructed as a polygon so that the inner handle piece can be connected with an inner, complementary polygonal contour in a torque-transmitting manner to the connection contour. The two polygonal contours are adapted to one another so that there is a transfer of torque from the inner handle piece onto the connection contour. This does not necessarily have the precondition that the inner connection contour of the inner handle piece and the polygonal contour to the connection piece must have the same geometry. Such a polygonal contour can be constructed, for example, as a hexagon. This contour extends in the longitudinal extension of the tool part. It is provided here that the inner contour of the handle piece and/or the outer contour of the connection contour are coordinated with one another in such a manner that one or more casting channels remain free between them. The casting channels serve to connect the inner handle piece to the connection contour of the tool part so that both parts are permanently connected to one another. Finally, these two parts can then no longer be separated from one another without destroying them. To this end the casting channels are filled in with a mass provided for the connection.

The handle of this hand-held tool comprises, in addition to the inner handle piece, an outer handle piece. The outer handle piece is a plastic part which is molded around the inner handle piece. This process is carried out after the inner handle piece has been connected to the connection contour. During the molding process of the outer handle piece, the casting channel or channels, which are open to the outside, are filled so that during the molding of the outer handle piece the inner handle piece is connected at the same time to the connection contour of the tool part. Therefore, basically no separate manufacturing step is needed for connecting the inner handle piece to the connection contour and also the use of another material is not needed. The inner handle piece set on the connection contour of the tool part replaces the inner plastic molding tool which is therefore lost in this process according the present disclosure.

The connection contour and the outer handle piece are typically produced in a plastic injection molding tool in successive steps. Due to the relatively simple geometries to be formed, a so-called on-off tool can be used; that is, a tool which basically functions without a slider or the like. The inner handle piece produced in a separate tool, typically in a separate plastic injection molding tool, can, on the other hand, have a complicated surface geometry as well as perforations, channels, undercuts or the like. Due to the production of the inner handle piece in a separate plastic injection molding tool, the on-off tool which is otherwise used for the manufacture can be operated with a higher cycle frequency. In this tool, the semi-finished products are inserted surrounding the tool part and the inner handle piece set on the connection contour of the tool part.

In such a method, one molding tool can be used to shape the outer handle piece in order to mold tool parts in it which differ regarding their diameter. Depending on the dimensioning of the connection contour of the tool part, it can be necessary under certain circumstances to use different inner handle pieces given different diameters of the tool parts. To this extent, the same handle size can be used for the production in spite of tool parts differing in diameter, that is: different blade sizes for screwdrivers using the same form cavity in which the outer handle piece is molded.

In addition, different handle designs can also be realized by the inner handle piece, which then constitutes the inner tool surface for the outer handle piece without changes having to be made to the on-off tool. During the molding of the outer handle piece, the hollow spaces remaining in the form cavity as well as the already mentioned casting channels are filled up with the plastic material used for producing the outer handle piece. Therefore, depending on the construction of the inner handle piece, the construction of the tool handle can be varied. Such a variation is possible, for example, regarding the geometry of surface sections of the inner handle piece, which also constitute in the finished tool handle an area of its outer surface. It is readily possible in this design to also form undercut areas in the inner handle piece into which the plastic mass penetrates from an open side in order to form the outer handle piece, which undercut areas comprise at least one perforation to a surface area not to be coated with this plastic component. In this manner, logos, writing or the like in the form of filled-out perforations on the outer surface of the handle can be made available with the plastic component used for forming the outer handle piece. Changes in the design of the tool handle can therefore be made solely by a change in the design of the inner handle piece. Changes to the on-off tool used for forming the connection contour and the outer handle piece are not required.

In the production of such a hand-held tool, tool handles can also be realized in small series, which was not possible with traditional technologies for reasons of cost.

The inner handle piece may have a greater hardness (according to Shore hardness) than the outer handle piece. In this manner, such a handle can be provided with a special grip. Another embodiment provides that the inner handle piece has a lesser hardness than the outer handle piece. In such an embodiment, the inner handle piece acts like a cushion which adapts to the hand of a person using the handle. In such an embodiment, the inner handle piece is typically totally surrounded by the outer handle piece, which is also flexible enough so that the flexible cushion effect of the inner handle piece can be effective. However, a high torque can be introduced into the handle and therefore into the tool by the harder outer handle piece forming a shell relative to the softer inner handle piece.

According to one embodiment, the inner handle piece is slid onto the connection contour of the tool part in a translatory sliding movement along the longitudinal extension of the tool part. To hold the inner handle part on the connection contour of the tool part in its proper position until the plastic mass used to form the outer handle piece has hardened in the plastic molding tool, an embodiment provides that the inner handle piece is fixed by a catch to the connection contour. It can be provided that the connection contour piece carries two catches which are diametrically arranged opposite one another on the outside of the connection contour and which can be elastically adjusted in the radial direction. The inner handle piece carries a catch recess at an appropriate position into which a catch engages when the inner handle piece is located in its proper position on the connection contour. The remaining play between the connection contour and the inner handle piece and the actual connection between these two parts takes place by the later filling of the one or more casting channels.

As mentioned above, this handle concept is especially suitable where the outer surface of the inner handle piece also forms areas of the outer surface of the tool handle. One embodiment provides for sealing these surface areas of the inner handle piece, which should not be coated by the other plastic component forming the outer handle piece, such that these areas of the inner handle piece are limited or surrounded by a circumferential sealing lip. This sealing lip acts against the inner wall of the tool cavity for forming the outer handle piece and lies under a certain prestress on the inner wall of the plastic molding tool. Such a sealing lip can be made available by an appropriate thinning of the material of the inner handle piece. Since a marking with a number of fields on the outside of the handle, viewed over the circumference of the tool handle, is repeated multiple times, this prestress measure ensures that the inner handle piece is held centered in the plastic molding tool when the outer handle piece is molded from the plastic component. Therefore, in such a forming of the tool handle, basically no other support measures for holding the inner handle piece in the plastic molding tool are required for forming the outer handle piece.

In an embodiment in which the outer surface of the handle comprises parts of the inner handle piece, it can be provided that these areas have a special shape and/or geometry. Therefore, one embodiment of a tool handle for a screwdriver handle provides that, in those outer surface areas of the inner handle piece which form the outer surface of the screwdriver handle, several rotary cam beads are arranged distributed over the outside of the circumference of the handle. Such an embodiment is not limited to the described embodiment of the tool handle as a screwdriver handle, but rather can also be used with other tool handles. At least a few of these rotary cam beads are inclined counter to the direction of screwing in (e.g., generally a clockwise rotation of the tool around its longitudinal axis to screw in a screw using a screwdriver), at least in sections of the cam beads extending in the direction of the blade of the screwdriver handle relative to the longitudinal handle axis. In addition, these rotary cam beads comprise, on their side facing against the direction of screwing in, a positioning surface inclined at a slight angle against the jacket surface surrounding the handle. In such a screwdriver handle, rotary cam beads are present that are inclined in their longitudinal extension with respect to the longitudinal extension of the handle, and therefore do not run parallel to the longitudinal extension of the handle in contrast to rotary cam beads in the prior art. The inclination of the longitudinal extension of these rotary cam beads is directed against the direction of screwing in when observed from the rear of the beads in the direction of the blade. These rotary cam beads comprise, on the side facing against the direction of screwing in, a positioning surface which is inclined at only a slight angle against the jacket surface of the handle or against the jacket surface surrounding the handle. In the framework of this disclosure, slight angles are to be considered angles smaller than 25°. In addition to an introduction of a torque into the screwdriver handle for screwing in a screw based on the inclined design of such a rotary cam bead relative to the longitudinal extension of the screwdriver handle, a rotary cam bead designed as described also makes available a moment acting in the longitudinal axial direction of the screwdriver handle in the direction of the torque-transmitting contour of the blade. This moment serves to retain an engagement position of the screwdriver blade with the rotary cam contour of the screw head upon the placing of a torque. As a consequence of these rotary cam beads, a part of the introduced torque is used for the required engagement positioning moment. To this extent, it is not absolutely necessary with such a screwdriver handle to introduce an additional pressure force. In the case of especially hard-to-turn screws, this aspect can also be particularly beneficial.

It is especially advantageous that this moment being made available for the engagement position is coupled to the coupled-in torque. This means that given a high applied torque, the moment to be retained for the engagement position between blade and screw is also correspondingly higher. Therefore, by the special design of the screwdriver handle, care must only be taken in the case of a high applied torque on the screwdriver handle that the blade is not levered out of the rotary cam contour of the screw.

The positioning surface made available counter to the direction of screwing in is inclined by only a slight angle opposite the jacket surface of the handle or the jacket surface surrounding the handle. This prevents the skin of the inside of the hand from being pinched if there is a possible slip between the hand of a person using the screwdriver and the screwdriver handle.

These inclined rotary cam beads can be provided in addition to rotary cam beads which follow the longitudinal extension of the screwdriver handle as regards their longitudinal extension. It is also possible that the screwdriver handle only comprises rotary cam beads inclined in the above-described manner.

An embodiment of such a screwdriver handle provides that the rotary cam beads are curved along their longitudinal extension, wherein the angle between the particular section of the rotary cam bead and the longitudinal axis of the handle becomes larger in the direction of the blade.

Tests have shown that it is sufficient if these rotary cam beads designed to be inclined relative to the longitudinal axis are limited to a central section of the screwdriver handle with respect to its longitudinal extension. Therefore, these rotary cam beads are typically located in the area of the screwdriver handle in which the handle has its greatest diameter relative to its typical barrel shape, in which section of the screwdriver handle the greatest torque is also applied.

In another embodiment of such a screwdriver handle, the circumference of the screwdriver handle around the longitudinal axis comprises a rounded jacket surface, and in particular a cross-sectional geometry in which several typically cycloidally-arched sections are provided. Along the circumference of the handle, the cycloidal arches sections are separated from each other by sections with a distinctly smaller radius of curvature. In such a typically smooth jacket surface of the screwdriver handle, and in this embodiment, wherein the following embodiment can also be used in other handle shapes, the rotary cam beads are worked out by recesses introduced into the outer surface of the handle in the area of the cycloidal arches. In such an embodiment, the geometry of the jacket surface surrounding the tool handle is preferably not changed, so that the rotary cam beads are not ribs, bulges or the like projecting over the jacket surface which is otherwise customary for such a handle. Such a recess is typically V-shaped, wherein the opening width of the flanks is relatively large and typically exceeds an angle of 160°. Therefore, the depth of the recesses does not have to be especially deep for working out the adjusting obliquity for the rotary cam beads in order to make a sufficiently large positioning surface available. It is sufficient if the maximum depth of such a recess for forming such a positioning surface is 0.5 mm. As a result of the slight inclination of the positioning surface, the positioning surface is sufficiently large in spite of the low depth of a recess providing the positioning surface, i.e., the positioning surface has a sufficient extent from the depth line of the recess to the upper end of the rotary cam bead for deriving the desired moment acting in the longitudinal direction from an applied torque.

A further embodiment provides that the extension of the positioning surface of the rotary cam bead which faces counter to the screwing in direction successively increases from its end facing the rear end of the screwdriver handle toward its other end in the extension from the depth line of the recess forming this positioning surface to the upper end. Therefore, the greatest height of the positioning surface of the rotary cam bead, in particular when the longitudinal axis of the rotary cam bead is curved in the previously described manner, is in the section in which the moment derived from the coupled-in torque is the greatest in the longitudinal direction.

Even if it is sufficient for screwing in a screw to provide such a screwdriver handle with only one positioning surface facing counter to the direction of screwing in, a further development provides also limiting the rotary cam bead by a recess on its side facing the direction of screwing in. This recess is designed analogously to the previously described recess for forming the positioning surface facing counter to the direction of screwing in. Two positioning surfaces following one another in the direction of screwing in are thus formed by this other recess, which is preferably also designed asymmetrically, for the screwing-in process, and which supports the making available of the desired engagement moment.

In addition to the aspects and embodiments described above, further aspects and embodiments will become apparent by reference to the accompanying drawings forming a part of this specification.

BRIEF DESCRIPTION OF THE DRAWINGS

The present disclosure is further described below with reference to the attached figures.

Before explaining the selected embodiments, it is to be understood that the present disclosure is not limited in application to the details of the particular arrangements shown and is capable of other embodiments. While certain embodiments are illustrated in reference to the figures, it is intended that the embodiments and figures disclosed herein are to be considered illustrative rather than limiting. Also, the terminology used herein is for the purpose of description and not of limitation.

DETAILED DESCRIPTION

Figure 1:
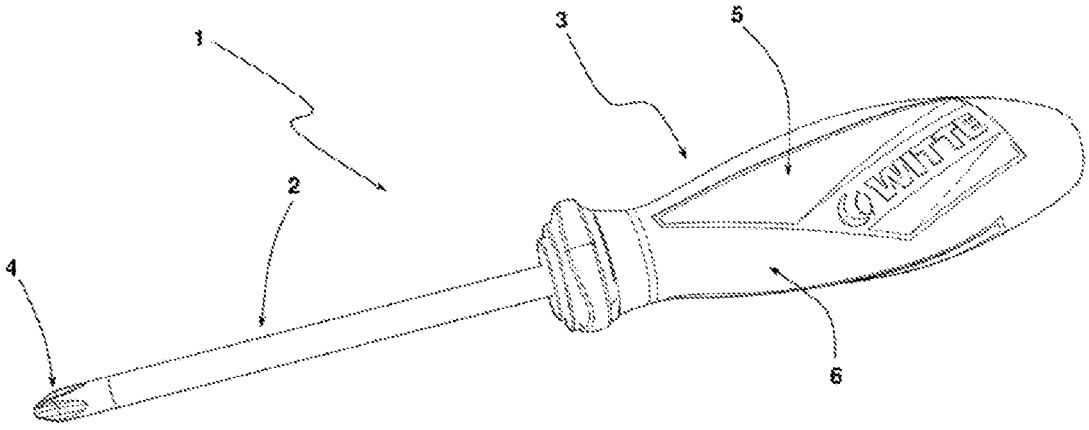
FIG. 1 shows a screwdriver comprising a tool part and a handle in a perspective view.

As seen in FIG. 1, screwdriver 1 as a hand-held tool comprises a tool part 2 and a handle 3. The tool part 2 is the blade of the screwdriver 1 which carries a rotary cam contour 4 on its free end. In the depicted embodiment, the rotary cam contour 4 is designed as a cross contour so that a cross-slot screw (not shown) can be activated with the screwdriver 1.

The handle 3 of the screwdriver 1 is composed of several components. In the depicted embodiment, the handle 3 consists of two components, namely an inner handle piece 5 and an outer handle piece 6. Since the inner handle piece 5 forms, in part, the outer surface of the handle 3 of the screwdriver 1 in the depicted embodiment, this component is visible in FIG. 1. The inner handle piece 5 is produced in the depicted embodiment from a plastic with a greater degree of hardness according to Shore than the outer handle piece 6.

Figure 2:
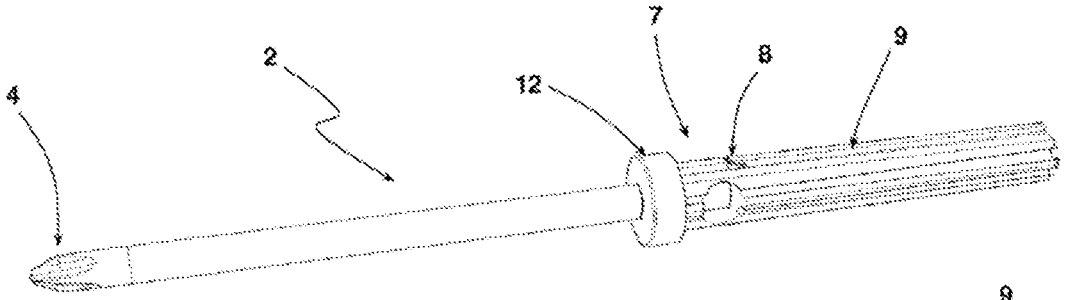
FIG. 2 shows the tool part of the screwdriver of FIG. 1 without the handle, with a connection contour arranged on it.
Figure 3:
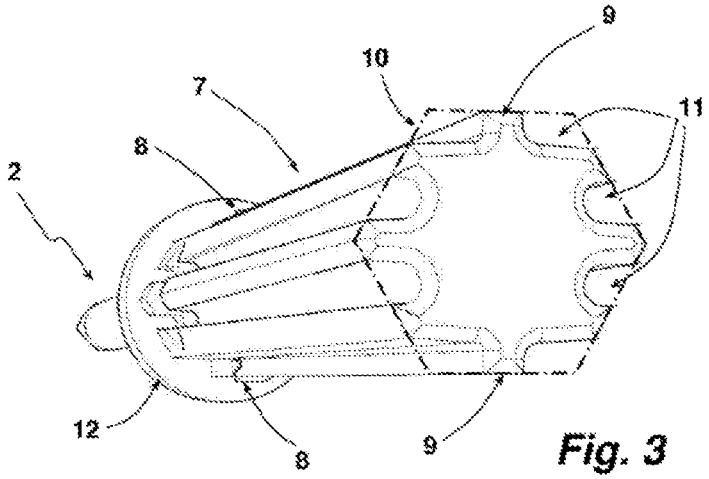
FIG. 3 shows a front side perspective view of the connection contour of the tool part of FIG. 2.

FIG. 2 shows the tool part 2 of the screwdriver 1. The end section of the tool part 2 opposite the rotary cam 4 is provided with a connection contour 7. In the depicted embodiment, the connection contour 7 is molded around this end of the tool part 2 which is flattened like a spatula for this purpose. The connection contour 7 is constructed as a polygon, wherein it is designed so that the inner handle piece 5 can be connected to it in a torque-transmitting manner. The connection contour 7 comprises several ribs following the longitudinal extension of the tool part 2. A catch 8 is seated on each of two ribs 9 which diametrically oppose one another. The catches 8 are made of the same plastic material as the other components of the connection contour 7. The perspective view onto the back side of the connection contour 7 in FIG. 3 more clearly shows the cross-sectional geometry of the connection contour 7. The actual connection contour 7 is a polygonal contour surrounding the individual ribs (which is sketched in in dotted lines in the figure for emphasizing the geometry). In the depicted embodiment, the jacket surface 10 virtually surrounding the connection contour 7 is designed as a regular hexagon. The ribs 9 carrying the catches 8 comprise a flat side for carrying the catches 8. In respect to the hexagonal jacket surface 10 of the connection contour 7, casting channels 11 along the longitudinal extension of the connection contour 7 are provided (only a few are identified in FIG. 3 with lead lines and this reference numeral for illustration). The casting channels 11 are located between the ribs. The casting channels 11 are open on the end even when the inner handle piece 5 has been slid onto the connection contour 7.

In the direction of the rotary cam contour of the tool part 2, the connection contour 7 ends in a plate 12.

In the depicted embodiment, the tool part 2 comprises the blade produced from a tool part, the rotary cam contour 4 and the connection contour 7 molded on it.

Figure 4:
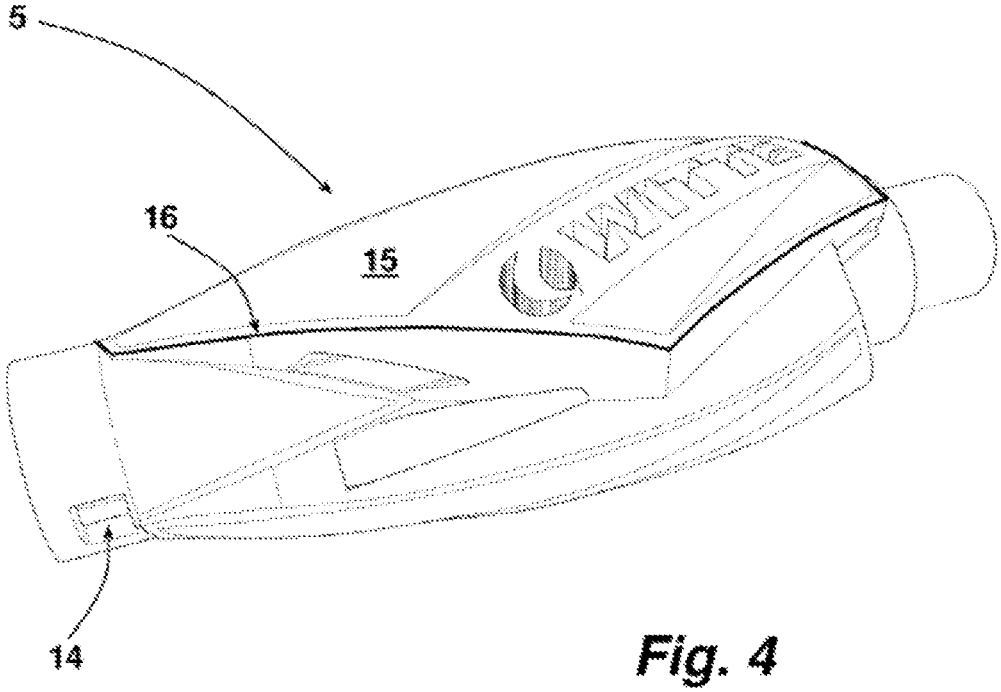
FIG. 4 shows a perspective view of an inner handle piece used to form the handle of the screwdriver of FIG. 1.
Figure 5:
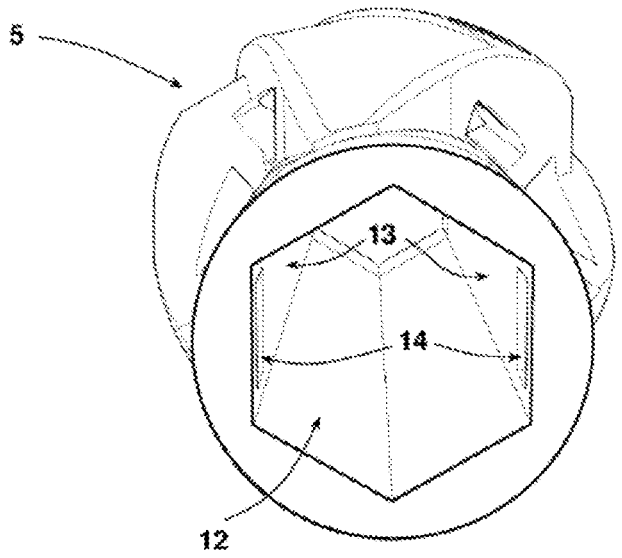
FIG. 5 shows a perspective view into an inner rotary cam contour of the inner handle piece of FIG. 4.

In order to produce the handle 3, the inner handle piece 5 shown in FIG. 4 has a contour complementary to the hexagonal connection contour 7 of the tool part 2 which is slid onto the connection contour 7. FIG. 5 shows a look into the rotary cam contour 12 of the inner handle piece 5, which contour 12 has a shape like a casing complementary to the connection contour 7. This shape of the rotatory cam contour 12 is also hexagonal, as can be clearly recognized from FIG. 5. Perforations 14 are introduced into the side surfaces 13 of this rotary cam contour 12. The surfaces of the perforations 14 rest on the exterior side surfaces of the ribs 9 at the positions corresponding to the catches 8 (see also FIG. 4). The catches 8 snap into these perforations 14 when the inner handle piece 5 has been slid sufficiently far onto the connection contour 7. This occurs when the front side of the inner handle piece 5 rests on the side of the plate 12 facing the connection contour 7.

As seen in the depicted embodiment in FIG. 4, parts of the outer surface of the inner handle piece 5 form the outer surface of the handle 3 of the screwdriver 1. These outer surface sections 15 of the inner handle part 5 form a certain number of fields on the outside of the handle 3. The areas of the inner handle piece 5 which form these fields of the handle 3 are separated from each other so that the outer handle piece 6 can be formed between these fields. During the later construction of the outer handle piece 6, the recesses present on the inner handle piece 5 are filled with a plastic mass opposite the outer side of the areas of the inner handle 5 forming the fields. The areas forming the fields are constructed as hollow bodies, as is apparent from the view of the back side of the inner handle piece 5 in FIG. 6. In the depicted embodiment, the hollow body forming at least one field is provided with perforations in order to show the word "WITTE" and a logo. These perforations are also filled with the plastic mass in the following step of forming the outer handle piece 6. Since the color of the plastic forming the outer handle piece 6 differs from the color of the inner handle piece 5, the writing and the logo are then clearly apparent.

Figure 4A:
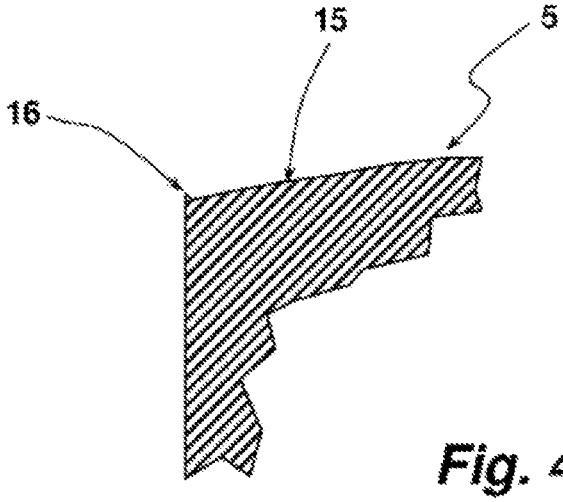
FIG. 4*a* shows an enlarged partial section view of the inner handle piece of FIG. 4.

To prevent coating the outer surface 15 of those areas of the inner handle piece 5 with the plastic mass used for the production of the outer handle piece 6, these areas of the inner handle piece 5 are limited or surrounded circumferentially by a sealing lip 16. FIG. 4*a* shows an enlarged view of an edge formation in the transition from a surface area 15 of the inner handle piece 5 forming the outer surface of the handle 3 to an adjacent area which is to comprise the outer handle piece 6. The sealing lip 16 is located at the border between these two areas. The sealing lip 16 is a thin continuation of material which extends a few tenths of a millimeter over the surface 15. During the production of the outer handle piece 6, the sealing lip 16 acts d against the inner wall of the mold cavity in which the outer handle piece 6 is molded.

Figure 6:
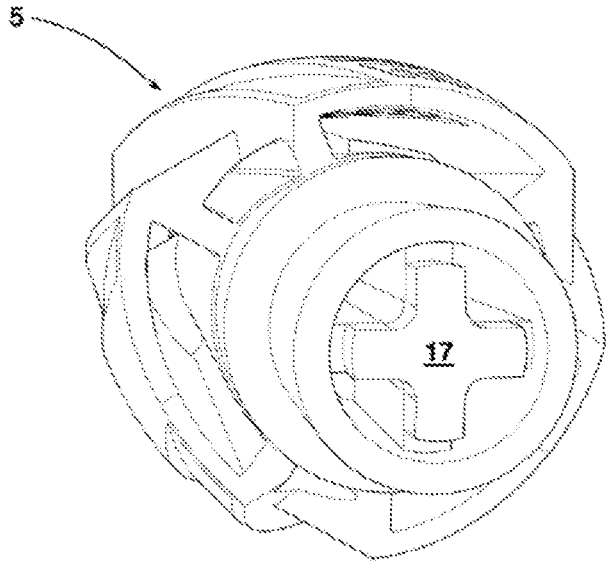
FIG. 6 shows a rear side perspective view of the inner handle piece shown in FIG. 4.

A symbol 17 visually indicating the type of the rotary cam contour 4 is also part of the inner handle piece 5, as is apparent from FIG. 6. Since the rotary cam contour 4 is a cross contour, the symbol 17 is also designed as a cross. The outer surface of the symbol 17, which can be recognized in FIG. 6, is not sprayed over by the plastic mass used to produce the outer handle piece 6. The outer surface of the symbol 17 is also provided with a circumferential sealing lip facing in the radial direction, such as was previously described on the surface areas of the inner handle piece 5 with respect to sealing lip 16.

To form the outer handle piece 6, the tool part 2 (with the inner handle 5 slid onto its outer contour 7) is placed in a plastic molding tool. The mold cavity of this tool corresponds to the outer form of the outer handle piece 6 to be produced. Since three surface areas 15 of the inner handle piece 5 are circumferentially distributed with the same angular distance from each other in the depicted embodiment, which three surface areas 15 are not to be coated with the plastic mass forming the outer handle piece 6 and are each limited by a circumferential sealing lip 16 facing outward in a radial direction, the sealing lips act against the inner wall of the mold cavity under a certain prestress. This configuration centers the arrangement of the inner handle piece 5 with the tool part 2 connected to it inside the mold cavity. Therefore, additional centering measures are basically unnecessary in such an embodiment.

The hollow spaces remaining in the tool cavity, which include the hollow spaces inside the inner handle piece 5 and the casting channels 11 between the inner handle piece 5 and the connection contour 7, are completely filled by the plastic mass introduced into the molding tool for molding the outer handle piece 6. Therefore, the plastic mass for forming the outer handle shell 6 is also used to connect the inner handle piece 5 to the connection contour 7 of the tool part 2.

In a further embodiment not shown in the figures, an insulation is provided on the connection contour of the tool part extending to its rotary cam contour.

Surface area 15 formed by the inner handle piece 5 (recognizable in FIG. 1 and shown on an enlarged scale in FIG. 7) carries a rotary cam bead 18 having its longitudinal extension, indicated by the writing "WITTE", running inclined relative to the longitudinal axis L of the handle 3. The inclination takes place in a direction in which the closure facing the tool part 2 is inclined counter to the direction of screwing in (rotating to the right). The longitudinal axis L is sketched into the handle 3 in dotted lines in FIG. 7. The rotary cam bead 18 in the depicted embodiment is introduced through a first recess 19 and a second recess 20 in the outer jacket surface of the screwdriver handle 3. This means that the outer flat side 21 of the rotary cam bead 18 corresponds in its course to the outer, surrounding jacket surface of the handle 3. Therefore, the rotary cam bead 18 does not project over the usual jacket surface of the handle 3 in the embodiment shown. The handle 3 is designed in the shape of a barrel in a side view. The rotary cam bead 18 is located in the area of the greatest bulging out of this barrel shape. In the circumferential direction around the barrel shape, the jacket surface of the handle 3 in the area of the rotary cam bead 18 comprises three cycloidal arches having a greater radius of curvature which are connected by crown sections having a smaller radius of curvature. The crowns with the smaller radii of curvature are made available by the outer handle piece 6. Therefore, these crowns, of which one is designated with the reference numeral 22 in FIG. 7, extend parallel to the longitudinal axis L of the handle 3 adjacent to the inclined rotary cam beads 18.

Figure 8:
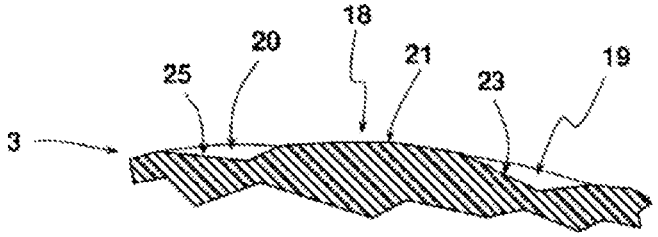
FIG. 8 shows a schematic partial section view through the handle along the line A-B in FIG. 7.

A positioning surface 23 facing counter to the direction of screwing in is made available by the recess 19. If a rotary moment is exerted on the handle 3 by a hand surrounding the handle 3, a part of the torque acting on it is brought into a moment directed in the direction of the rotary cam contour 4 on account of the alignment of the positioning surface 23 inclined relative to the longitudinal axis L. The depth line 24 of the recess 19 merges at both ends into the adjacent handle surface. This has the consequence that the positioning surface 23 successively increases from its end facing away from the tool part 2 toward its other end. The recess 19 itself is V-shaped in its cross-sectional geometry, as is schematically shown in FIG. 8. The opening angle of the flanks of the recess 19 is slightly more than 160°.

The torque bead 18 is limited in its screwing-in direction by the recess 20. A second positioning surface 25 is formed by the recess 20 and faces counter to the direction of screwing in. When a torque is applied onto the handle 3 by the hand of a user, not only is a rotary movement transferred onto the handle 3 by the recesses 19, 20 and the positioning surfaces 23, 25 formed as a consequence (for which the previously-described, longitudinally-axial rotary cam beads 18 also serve), but a part of the introduced moment is also diverted via both positioning surfaces 23, 25 in the longitudinal axial direction to the rotary cam contour 4, by which moment the screwdriver 1 quasi automatically follows the successive advance of a screw activated by the above, in any case as long as a torque is being applied.

Figure 7:
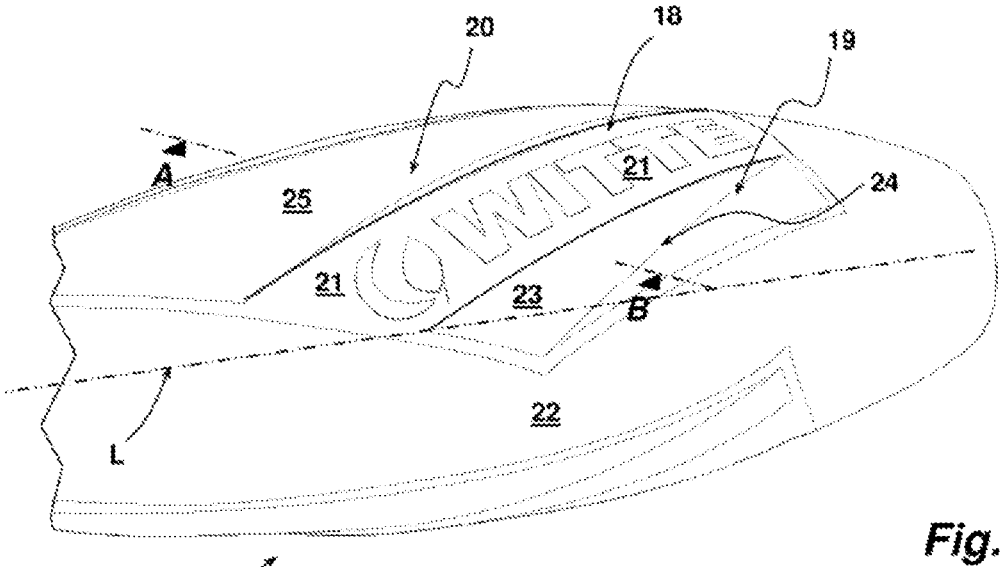
FIG. 7 shows an enlarged view of a section from the handle of the screwdriver of FIG. 1.

An embodiment that is not shown in the figures provides that only one of the two recesses shown in FIG. 7 is provided and, therefore, only one positioning surface is made available. An embodiment is also possible in which a rotary cam bead projects somewhat opposite the jacket surface of the other handle components.

While a number of aspects and embodiments have been discussed, those of skill in the art will recognize certain modifications, permutations, additions and sub-combinations are possible. It is intended that the following claims are interpreted to include all such modifications, permutations, additions and sub-combinations, as they are within the true spirit and scope of the present disclosure and the claims. Each embodiment described herein has numerous equivalents.

The terms and expressions which have been employed are used as terms of description and not of limitation, and there is no intention in the use of such terms and expressions to exclude any equivalents of the features shown and described or portions thereof, but it is recognized that various modifications are possible within the scope of the invention claimed. Accordingly, it should be understood that although the invention has been specifically disclosed by selected embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure. When a Markush group or other grouping is used herein, all individual members of the group and all combinations and sub-combinations possible of the group are intended to be individually included in the disclosure.

In general, the terms and phrases used herein have their art-recognized meaning, which can be found by reference to standard texts, journal references and contexts known to those skilled in the art. The above definitions are provided to clarify their specific use in the context of the invention.

LIST OF REFERENCE NUMERALS

1 screwdriver
2 tool part
3 handle
4 rotary cam contour
5 inner handle piece
6 outer handle piece
7 connection contour
8 catch
9 rib
10 jacket surface
11 casting channel
12 rotary cam contour
13 side surface
14 perforation
15 outer surface
16 sealing lip
17 symbol
18 rotary cam bead
19 recess
20 recess
21 flat side
22 crown
23 positioning surface
24 depth line
25 positioning surface
L longitudinal axis

The invention claimed is:

1. A hand-held tool comprising:

a tool part and a handle surrounding the tool part, the handle connected to the tool part in a torque-transmitting manner;

the tool part has a connection contour for the torque-transmitting connection to the handle at least in a section of the tool part surrounded by the handle, the connection contour having ribs which project outward and extend longitudinally along the connection contour, with casting channels open in a radial direction thereby provided between the ribs;

the connection contour being a plastic part injection-molded around the section of the tool part and connected thereto in a torque-transmitting manner;

the handle comprising an inner handle piece and an outer handle piece;

the inner handle piece has an interior cavity which extends into the inner handle piece in a longitudinal direction, and the connection contour is arranged within said interior cavity and surrounded by the inner handle piece in a torque-transferring manner thereby forming a unit, wherein the casting channels provided between the ribs of the connection contour are closed in a radial direction by surfaces of the inner handle piece which surround the connection contour in the interior cavity of the inner handle piece;

the outer handle piece made of a plastic material and formed around the unit consisting of the tool part with the inner handle piece arranged on the connection contour during a plastic molding process, wherein the plastic material of the outer handle piece extends through the casting channels provided between the connection contour and the inner handle piece and thereby permanently connects the inner handle piece to the connection contour of the tool part.

2. The hand-held tool of claim 1, wherein the inner handle piece is a plastic part produced in a tool separately from the production of the connection contour and the outer handle piece, and the inner handle piece is not injection-molded around the connection contour.

3. The hand-held tool of claim 1, wherein a cross section of the connection contour is constructed as a polygonal contour defined by a jacket surface, with free ends of the ribs of the connection contour terminating along the jacket surface and areas of the connection contour between the ribs receding from the jacket surface that surrounds the connection contour, wherein the inner handle piece does not engage or only partially engages said areas, and each of the areas forms one of the casting channels.

4. The hand-held tool of claim 1, wherein the inner handle piece is fixed on the connection contour by at least one catch.

5. The hand-held tool of claim 4, wherein an outer side of the connection contour carries the at least one catch which engages into a catch recess of the inner handle piece when the inner handle piece is slid onto the connection contour.

6. The hand-held tool of claim 1, wherein at least one outer surface section of the inner handle piece simultaneously forms an area of the outer surface of the handle of the hand-held tool.

7. The hand-held tool of claim 6, wherein an edge of the at least one outer surface section of the inner handle piece is formed by a sealing lip, the sealing lip configured to rest on the inner mold cavity of a molding tool during a plastic molding process for producing the outer handle piece.

8. The hand-held tool of claim 6, wherein the at least one surface section of the inner handle piece comprises a soft coating.

9. The hand-held tool of claim 6, wherein the least one surface section of the inner handle piece comprises one or more perforations filled with the material of the outer handle piece.

10. The hand-held tool of claim 9, wherein the one or more perforations are designed as writing and/or as a logo.

11. The hand-held tool of claim 1, wherein the hand-held tool is a screwdriver.

12. The hand-held tool of claim 11, wherein the screwdriver carries several rotary cam beads arranged circumferentially distributed on the outside of the handle, wherein at least a few of the rotary cam beads are inclined at least in sections opposite the longitudinal axis (L) of the handle extending in the direction of the blade of the screwdriver counter to the direction of screwing in, and that said rotary cam beads comprise a positioning surface on their side facing counter to the direction of screwing in, the positioning surface inclined at a slight angle opposite the jacket surface surrounding the handle.

13. A method for producing a hand-held tool with a tool handle connected to a tool part, comprising the following steps:

molding a connection contour made of plastic around a section of the tool part, the connection contour having an outer rotary cam contour and casting channels open to the outside;

sliding an inner handle piece onto the connection contour, the inner handle piece surrounding the connection contour in a torque-transmitting manner; and molding an outer handle piece made of plastic in a molding tool onto the inner handle piece located in the molding tool and connected to the connection contour, whereby the casting channels between the inner handle piece and the connection contour are at least partially filled with plastic provided for forming the outer handle piece, and therefore the inner handle piece is permanently connected to the connection contour.

14. The method of claim 13, wherein the connection contour and the outer handle piece are produced in a following plastic molding tool in successive steps, in contrast to the inner handle piece which is produced in a separate molding tool and is connected to the connection contour before the step of molding the outer handle piece.

15. The method of claim 13, wherein the inner handle piece is produced in a tool separately from the step of molding the connection contour around the tool part, and the inner handle piece is not injection-molded around the connection contour.

* * * * *